US010893999B2

(12) United States Patent
Gleixner

(10) Patent No.: US 10,893,999 B2
(45) Date of Patent: Jan. 19, 2021

(54) MULTI-PART DEVICE FOR CONTROLLED CARDIOPULMONARY RESUSCITATION DURING CARDIAC ARREST

(71) Applicant: INOTECH Kunststofftechnik GmbH, Nabburg (DE)

(72) Inventor: Josef Gleixner, Nabburg (DE)

(73) Assignee: INOTECH KUNSTSTOFFTECHNIK GMBH, Nabburg (DE)

( * ) Notice: Subject to any disclaimer, the term of this patent is extended or adjusted under 35 U.S.C. 154(b) by 593 days.

(21) Appl. No.: 15/520,353

(22) PCT Filed: Sep. 21, 2015

(86) PCT No.: PCT/EP2015/071617
§ 371 (c)(1),
(2) Date: Apr. 19, 2017

(87) PCT Pub. No.: WO2016/087070
PCT Pub. Date: Jun. 9, 2016

(65) Prior Publication Data

US 2017/0312170 A1 Nov. 2, 2017

(30) Foreign Application Priority Data

Dec. 5, 2014 (DE) ..... 10 2014 014 074

(51) Int. Cl.
*A61H 31/00* (2006.01)

(52) U.S. Cl.
CPC ..... *A61H 31/005* (2013.01); *A61H 31/007* (2013.01); *A61H 2031/003* (2013.01);
(Continued)

(58) Field of Classification Search
CPC .... A61H 31/00; A61H 31/004; A61H 31/005; A61H 31/006; A61H 31/007;
(Continued)

(56) References Cited

U.S. PATENT DOCUMENTS 3,209,747 A 10/1965 Guentner
3,209,748 A 10/1965 Thomas
(Continued)

FOREIGN PATENT DOCUMENTS

CN 201304070 Y 9/2009
DE 1491611 A1 2/1970
(Continued)

OTHER PUBLICATIONS

Chinese Second Office Action, dated Sep. 11, 2018, in Chinese Patent Application No. 2015 80052553.4, a related application, 4 pp.
(Continued)

*Primary Examiner* — Samchuan C Yao
*Assistant Examiner* — Cana A Gallegos
(74) *Attorney, Agent, or Firm* — Leydig, Volt & Mayer, Ltd.

(57) ABSTRACT

The invention relates to a device for controlled cardiopulmonary resuscitation, which allows the user to reanimate a human body quickly and simply during a cardiac arrest. The geometric dimensions of the claimed device are comparatively small and lie between approximately 10 and 25 cm in diameter and approximately 6 and 12 cm in height. During use, a force K is exerted onto a first force transmission means, a clearly audible signal being generated when a maximum adjustable force exertion Kmax is reached. Said clearly audible signal is primarily generated by the interaction of oscillatory elements of said device.

14 Claims, 2 Drawing Sheets

(52) U.S. Cl.
CPC ..... *A61H 2201/0184* (2013.01); *A61H 2201/5048* (2013.01)

(58) Field of Classification Search
CPC ..... A61H 31/008; A61H 31/02; A61H 2031/001; A61H 2031/002; A61H 2031/003; A61H 2031/025; A61H 23/00; A61H 23/004; A61H 23/006; A61H 2201/0184
See application file for complete search history.

(56) References Cited

U.S. PATENT DOCUMENTS

| | | | | |
|---|---|---|---|---|
| 3,291,124 | A | 12/1966 | Jennings et al. | |
| 4,554,910 | A * | 11/1985 | Lally | A61H 31/005 446/415 |
| 5,645,522 | A * | 7/1997 | Lurie | A61H 31/00 601/43 |
| 5,738,637 | A * | 4/1998 | Kelly | A61H 31/005 601/41 |
| 2013/0066242 | A1* | 3/2013 | Wood | A61H 31/005 601/41 |
| 2016/0128898 | A1* | 5/2016 | Hagl | A61H 31/005 601/15 |

FOREIGN PATENT DOCUMENTS

| | | | |
|---|---|---|---|
| DE | 202004002059 | U1 | 3/2005 |
| JP | 2013-160982 | A | 8/2013 |
| KR | 10-2011-0003321 | U | 4/2011 |
| WO | WO 2004/056303 | A1 | 7/2004 |
| WO | WO 2006/101400 | A1 | 9/2006 |
| WO | WO 2014/071915 | A2 | 5/2014 |

OTHER PUBLICATIONS

Examination Report corresponding to German Patent Application No. 102014014074.1, dated Sep. 8, 2015—with English translation.
International Search Report with Written Opining corresponding to International Patent Application No. PCT/EP2015/071617, dated Dec. 10, 2015.
Notice of Allowance corresponding to German Patent Application No. 102014014074.1, dated Feb. 2, 2018—with English translation.
Summons for Hearing corresponding to German Patent Application No. 102014014074.1, issued on Nov. 24, 2017—with English translation.
Chinese First Office Action, dated Jun. 21, 2018, in Chinese Patent Application No. 2015 80052553.4, related application, 9 pp.
Chinese Third Office Action, dated Dec. 29, 2018, in Chinese Patent Application No. 2015 80052553.4, a related application, 9 pp.

* cited by examiner

MULTI-PART DEVICE FOR CONTROLLED CARDIOPULMONARY RESUSCITATION DURING CARDIAC ARREST

CROSS-REFERENCE TO RELATED APPLICATIONS

This application is a U.S. National Stage Application filed under 35 U.S.C. § 371 of International Application No. PCT/EP2015/071617, filed Sep. 21, 2015, which claims the benefit of German Application No. 10 2014014074.1, filed Dec. 5, 2014. Both of these applications are hereby incorporated by reference in their entireties.

BACKGROUND OF THE INVENTION

The present invention relates to a multi-part device for controlled cardiopulmonary resuscitation, cardiopulmonary resuscitation (heart-lung reanimation), during cardiac arrest having a clearly audible signal when a limit force, which acts on the thorax of the human body, is reached, in particular having a device with a special spring design and shaping, which facilitates the treatment of a patient during acute application.

Devices of this type are known in the prior art from WO 2014/071915 A2. This document discloses a device for cardiopulmonary resuscitation during cardiac arrest having at least one pressure transmission means and at least one pressure-absorbing element and a pressure indicator, which, on the occurrence of a mechanical limit pressure ($F_{max}$), generates a signal (S), which is perceptible by human sensory organs. Arranged between the at least one pressure transmission means and the at least one pressure-absorbing element is a spring system having two different springs, which, when a predetermined limit pressure is reached, generates an audible first click signal by means of one of the two springs, and when the limit pressure is relieved, generates a second click signal. It has proved to be disadvantageous in this invention that the transmission of the click signal does not sound clearly enough because the signal generated undergoes too high an attenuation during outward transmission.

A further resuscitation apparatus having a pressure indicator is also disclosed in U.S. Pat. No. 4,554,910, which apparatus generates first and second acoustic click signals by means of a U-shaped leaf spring, which is arranged approximately in the centre of a second spring and is configured as a coiled spring. It is felt to be disadvantageous in an apparatus of this type for cardiopulmonary resuscitation during cardiac arrest that the mechanical pressure always has to act centrally on the pressure transmission means to achieve the desired effect for resuscitation. This is not possible during practical use.

A similar elongate apparatus is disclosed in CN 201304070 Y, which apparatus also has two pressure transmission means, between which a coiled spring is arranged and, when a limit pressure is reached, generates an audible signal and signals to the user to relieve the pressure transmission means again. It is felt to be disadvantageous in this apparatus that it is difficult to maintain a stable position on the sternum in an emergency.

Furthermore, WO 2006/101400 A1 discloses a device for manual pressure generation on the thorax of a human body. This device has a mechanical sound generator, which, when a predetermined pressure is reached, generates a sound. For this purpose, a plate is brought into a holder, which holds the plate in a curved prestress and generates a sound when the plate is pushed down. The pressure measurement itself is carried out by means of another mechanism, which is described in more detail in WO 2004/056303 A1. It is felt to be disadvantageous in a device of this type for cardiopulmonary massage that, as a result of the absolute functional safety requirements for a device of this type, the interaction of all the mechanical components appears too complicated, so the desired safety cannot be ensured.

A portable cardiac massage apparatus is also disclosed in DE 1491611 and consists of a base plate and a punch arranged thereabove, the punch being actuated cyclically by means of a pneumatic mechanism and thus acting on the thorax of the human body.

As it is generally important to carry out resuscitation as quickly as possible during cardiac arrest, the apparatuses available are often too laborious with regard to their handling and complicated to operate, so valuable time may thereby be lost for resuscitation of the human body, which has far-reaching consequences.

The object of the present invention is therefore to avoid the drawbacks of the prior art and to provide an apparatus for cardiopulmonary resuscitation, which is simple and easy for lay people in this field to operate and which is able, on the one hand, to allow a controlled safe pressure force to act cyclically on the thorax of the human body and, on the other hand, to generate a clearly audible signal with simple means.

This object is achieved by the characterising features of the main claims. Further features essential to the invention are to be inferred from the sub-claims and the detailed description.

BRIEF SUMMARY OF THE INVENTION

The present invention provides a device for controlled cardiopulmonary resuscitation, which is able to carry out a quick and uncomplicated resuscitation of a human body during cardiac arrest. The geometric dimensions of the device according to the invention are comparatively small and are between approximately 10 and 25 cm in diameter and about 6 to 12 cm in height. During application, a pressure K is cyclically exerted on a first pressure transmission means and when a maximum force exertion $K_{max}$ is reached, a clearly audible signal is generated, which is brought about as a result of the interaction of spring elements, which are substantially arranged between the first force transmission means and a base plate.

The multi-part device according to the invention for generating a clearly audible sound when an outer force (K) acts on a first force transmission means, which acts via a spring system on a base plate in an apparatus for controlled cardiopulmonary resuscitation of the human body during cardiac arrest, is characterised in that the outer geometric dimensions and shapes are adapted to the anatomical conditions of the thorax close to the sternum, and the spring system, on the one hand, generates a signal, which acts on at least one oscillatory element (8, 9). This multi-part device comprises at least one spring system having a plurality of spring elements, which interact when the mechanical force K is exerted, at least one spring element being planar and configured in one piece and at least two spring elements being arranged to the side of the planar spring element.

It is advantageous in this case that a planar one-piece spring element, which, when a mechanical force K acts, allows an adjustable limit force $K_{max}$ to be recognised and, when the force K is relieved, springs back spontaneously into the original start position of the spring element, wherein both when the limit value $K_{max}$ is reached and on resetting into the start position, a clearly audible signal sounds, which acts both mechanically and acoustically on the surroundings supporting the spring element.

It is furthermore advantageous that the unit generating the signal has at least one clicking plate configured as desired with at least one curvature, on which at least one oscillatory element acts.

It is furthermore advantageous that the outer shape of the clicking plate can be configured as desired, for example oval, polygonal, heart-shaped, preferably round.

It is also advantageous that the clicking plate spontaneously generates a clicking sound when a predetermined bending in one direction is reached.

A further advantage is to be seen in the arrangement of a peripheral oscillatory web on the first force transmission means.

It is furthermore advantageous that, when the force effect is relieved, the clicking plate independently springs back resiliently and is arranged coaxially with respect to the first force transmission means.

It is also advantageous that at least one spring element is arranged to the side of the planar spring element.

A further advantage is to be seen in that at least one elevation on the plane of the base plate interacts with at least one projection on the inside of the first force transmission means in such a way that they engage with one another, at least one spring element being under a predetermined prestress.

It is furthermore advantageous that at least one elevation on the base plate and at least one projection on the inside of the first force transmission means receive at least one compression spring.

An advantageous configuration is to be seen in that the elevations and projections are configured as guide elements, which, on the one hand, define the lift of the first force transmission means and, on the other hand, secure the first force transmission means against rotation.

It is also advantageous that the planar clicking plate rests loosely at least on three narrow support points at the edge of the clicking plate.

A further advantage is to be seen in that the lateral oscillatory webs have recesses, which have different shapings, for example angular or arcuate.

It is furthermore advantageous that a shaped foam, the surface of which is concave, is arranged on the outside of the base plate.

It is also advantageous that the cover face of the first force transmission means is concave, the cover face being able to have at least one curvature.

It is furthermore advantageous that the method for generating a clearly audible sound, when an outer force K acts on a first force transmission means, which acts via a spring system on a base plate in an apparatus for controlled cardiopulmonary resuscitation of the human body during cardiac arrest, is characterised in that a clearly audible signal S is generated by the interaction of a spring system when an adjustable limit pressure $K_{max}$ is reached, said signal being transmitted to oscillatory elements.

Further features that are essential to the invention are to be inferred from the description and the sub-claims.

BRIEF DESCRIPTION OF THE SEVERAL VIEWS OF THE DRAWINGS

The invention will now be described in more detail below with the aid of drawings, in which.

DETAILED DESCRIPTION OF THE INVENTION

Figure 1:
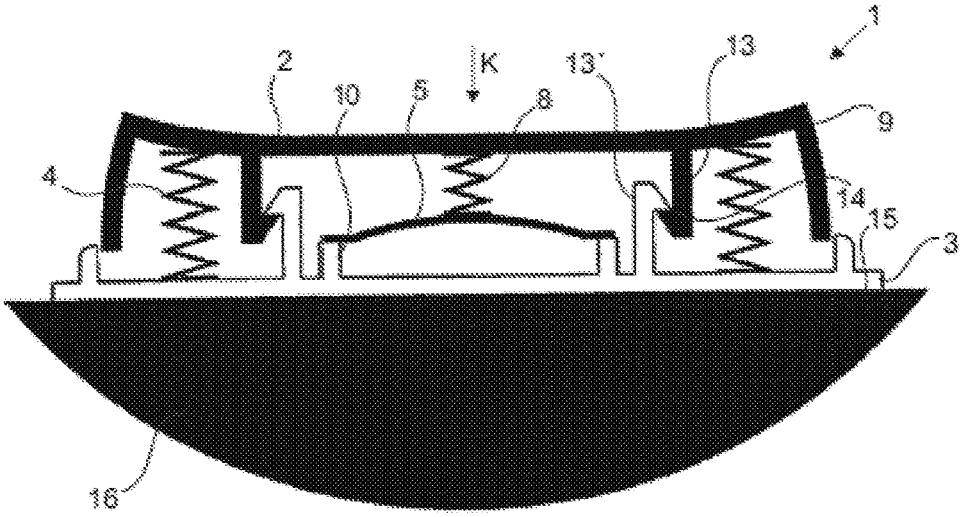
FIG. 1 is a schematic side view of an embodiment of a device (1) according to the invention having a spring system (4, 5, 8) between at least one first force transmission means (2) and a base plate (3)

FIG. 1 is a schematic side view of a possible embodiment of the device 1 with its essential structural elements. This device 1 consists of a first force transmission means 2, which is arranged over the force-absorbing base plate 3. Arranged between the first force transmission means 2 and the base plate 3 is a complicated spring system, which substantially consists of at least one spring element 4 and a planar spring element 5, which is configured as a clicking plate. The at least one spring element 4 is arranged to the side of the clicking plate 5 on a circular path, at least three spring elements 4 preferably being necessary to exert, on the base plate 3, a uniform force K on the available face of the base plate 3. The force K to be exerted on the first force transmission means 2 is generally between 35 and 45 kg, preferably about 40 kg, which is necessary in order to be used effectively during resuscitation of cardiopulmonary activity. In a preferred embodiment, there are four coiled springs 4, which are arranged around the clicking plate 5 on a predetermined circular path. The spring constant or spring rate R of the spring element 4 is 8.861 N/mm. The coiled spring 4 is ground at the upper and lower supports to obtain a defined support face on the base plate 3 and the first force transmission means 2. The diameter of the circular path, on which the spring elements 4 are arranged, should not exceed 100 mm so as not to make the geometric dimensions of the entire device too large, which is substantially determined by the anatomical dimensions of the thorax of the human body and by operating safety. The diameter of the planar clicking plate 5 is between approximately 30 mm and 55 mm and rests quasi in a point-shaped manner with its edge region 22 on the periphery on at least three support points 10, which rise from the plane of the base plate 3. The clicking plate 5, in the central region, has at least one curvature 7, on the upper point of which is arranged at least one second oscillatory element 8 with its one end. The other end is non-positively supported on the lower side of the first force transmission means 2. The first force transmission means 2 is virtually U-shaped in cross section, so the two sides of the U-shaped cross section, or elevations from the plane of the lower side of the first force transmission means 2, are configured as at least one oscillatory part 9 (see below), which picks up the sound waves generated by the clicking plate 5 and transmits them outwardly. In the assembled state, the spring elements 4, 5, 8 arranged between the base plate 3 and the first force transmission means 2 all have a specific prestress, which is generated in that the first force transmission means 2 and the base plate 3 each have an elevation 13, 13' having a snap fit 14 at the end of the elevation. The snap fit 14 furthermore has a guide having a longitudinally directed degree of freedom, in which the hook of the elevation 13 moves. When the first force transmission means 2 and the base plate 3 are guided together, the two ends of the respective elevations hook into one another up to a predetermined stop, so the individual spring elements 4, 5, 8, in the assembled state, all have a specific predetermined prestress, which ultimately, as a result of the interaction between the individual spring elements, have a resulting pressure force of about 40 kg, which is necessary to lead the clicking plate 5 at the limit value to the "breakthrough" of the clicking plate 5, at which it generates a clearly perceptible sound, which is substantially transmitted to the lateral oscillatory parts at the first force transmission means 2 and is amplified by modulation of the sound waves at the oscillatory parts 9 and of the sound waves arriving directly through the recesses 9' as a result of superimpositions of the various wave ranges in the perceptible range, so consequently a clearly audible signal sounds when the predetermined force $K_{max}$ of about 40 kg is reached. When the exerted force K on the first force transmission means 2 is removed, the clicking plate 5, or unit 5 generating the signal, springs back automatically into its starting position while emitting a further signal. A shaped part 16 is arranged on the lower side 15 of the base plate 3. The shaped part 16 consists of a suitable foam, such as, for example, a foam rubber, which, on the one hand, develops a resilient effect and, on the other hand, is moisture-absorbent and, as a result of its material properties and pore size, develops a specific adhesiveness on the bare skin, which has a particularly favourable effect when treating the patient. Because of the resilient effect of the foam of the shaped part 16, this spring force is to be included in the calculation of the total force of about 40 kg to generate the first audible signal. The surface of the shaped part 16 resting on the bare skin of the patient is substantially adapted to the anatomy of the thorax in the region of the sternum. The shaped part 16 is pear-shaped in plan view, wherein the thinner end 17' of the foam part 16 should approximately coincide with the position of the lower end of the sternum when treating the patient to develop the optimum effect during resuscitation of the patient.

Figure 2:
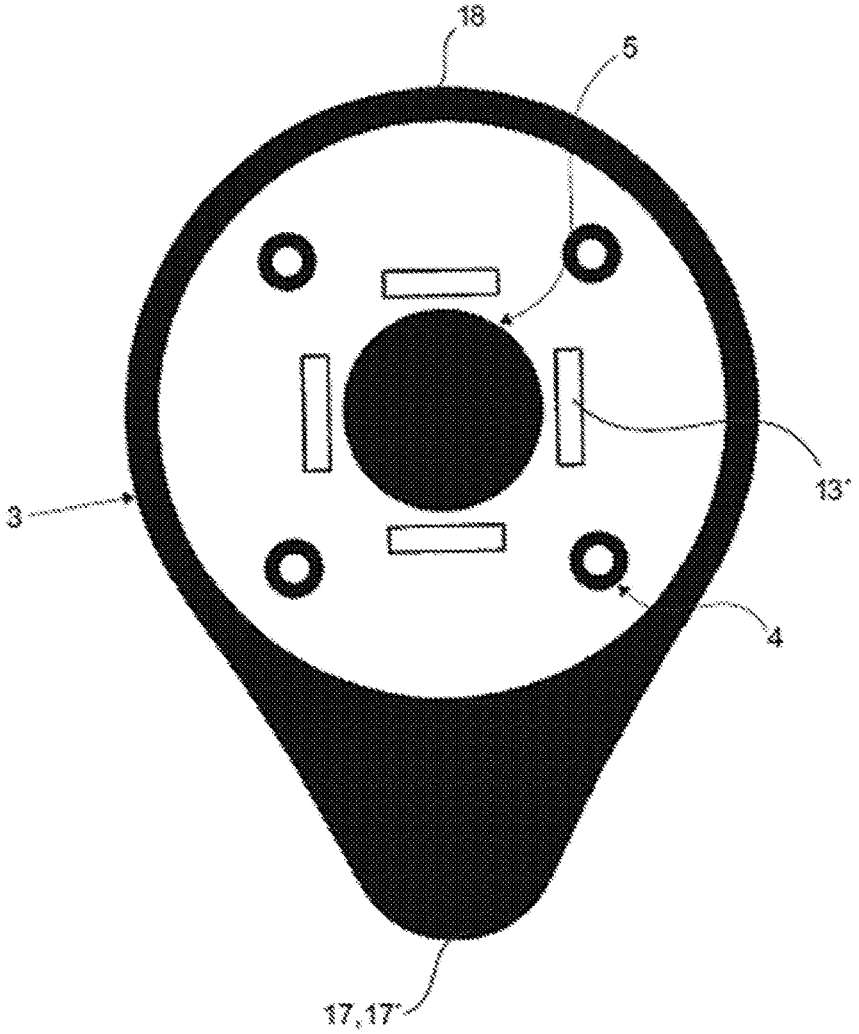
FIG. 2 is a schematic plan view of the pear-shaped base plate (3) having an inserted clicking plate (5) around which four spring elements (4) are arranged.

FIG. 2 is a schematic plan view of the inside of the base plate 3 having an inserted clicking plate 5, around which are arranged four spring elements 4. The shaping of the base plate 3 is substantially pear-shaped with a thick end 18 and a thin end 17. The compression spring elements 4 are arranged on a circular path, wherein the number of compression spring elements 4 should not be less than three in order to develop an approximately uniform pressure on the base plate 3 with an irregular force exertion K on the first force transmission means 2, so when the limit force $K_{max}$ of 40 kg is reached, a signal is generated. Likewise, at least three elevations 13' used for anchoring the first force transmission means 2 to the base plate 3 to form a prestress of the spring system are arranged on a circular path, which, in the present embodiment, is narrower than that of the spring elements 4. Arranged approximately centrally in the upper thicker part 18 of the base plate 3 is the clicking plate 5, which, in the simplest case, is formed integrally, but may also be multi-part and/or slotted. The outer shape of the clicking plate 5 can be selected as desired, preferably round.

Figure 3:
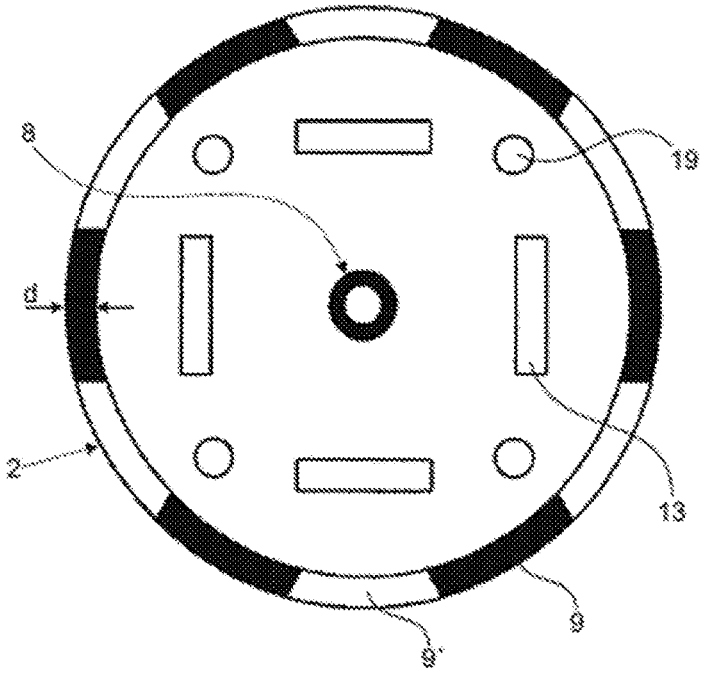
FIG. 3 is a schematic plan view of the lower side of the first force transmission means (2)

FIG. 3 is a schematic plan view of the lower side of the first force transmission means 2 in a round embodiment. Arranged in the region of the periphery of the first force transmission means 2 are oscillatory parts 9, which can also be configured as a web with recesses 9'. The oscillatory parts 9 on the peripheral edge of the first force transmission means 2 are advantageously produced from the same material as the cover face of the first force transmission means 2. The oscillatory parts are slightly thinner with respect to the thickness d than the thickness D of the cover face of the first force transmission means 2 in order to better be able to transmit the sound oscillations. Overall, the first force transmission means 2 acts as a resonance body, on which, on the one hand, the oscillations of the oscillatory spring element 8 and, on the other hand, the sound oscillations generated by the clicking plate 5 (signal-producing unit) act in particular on the lateral peripheral oscillatory parts 9. The oscillatory spring element 8 arranged around the centre point of the first force transmission means 2 carries out a plurality of functions. On the one hand, it transmits the lift of the first force transmission means 2 to the clicking plate 5 and, on the other hand, it absorbs the oscillations of the clicking plate 5 and transmits them to the resonance body, i.e. onto the lower side of the first force transmission means 2, without decisively damping the oscillations. The spring constant of the spring element 8 has to be greater than the spring constant of the clicking plate 5 to press the clicking plate 5 to the "breakthrough" generating the signal, at which it generates a clearly perceptible signal.

Figure 4:
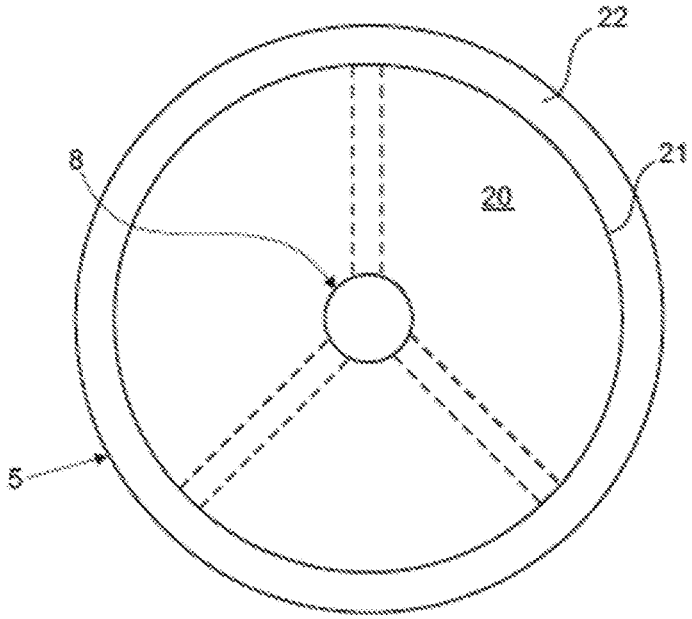
FIG. 4 is a schematic plan view of the element (5) generating the signal, which element is configured as a clicking plate.
Figure 5:
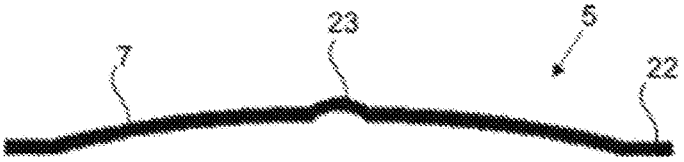
FIG. 5 is a schematic side view of the clicking plate (5).

FIG. 4 is the plan view of an embodiment of a clicking plate 5 in a round embodiment. The outer diameter is between 22 mm and 55 mm, preferably about 45 mm, in order to take into account the anatomical conditions of the human thorax with the geometric dimensions. In the edge region, the clicking plate 5 has a bending edge 21, so an annular face 22 is formed, which is used as a loose support face for at least three support elements 10. The central face 20 is arcuately curved and is actuated by the spring element 8 in both directions. In a further embodiment, the central face 20 has slots 22, which are used to change the sound and also to amplify the volume of the signal generated by superimposing the different wave packets. As FIG. 5 clearly shows, a curved elevation 23, which provides the spring element 8 with a certain hold on the curvature of the face 20, can be impressed around the centre point.

In conclusion, the present invention provides a device 1 for controlled cardiopulmonary resuscitation, which device enables the user to carry out a quick and uncomplicated resuscitation of a human body during cardiac arrest. The geometric dimensions of the device 1 according to the invention are comparatively small and are between approximately 10 and 25 cm in diameter and about 6 to 12 cm in height. During application, a force K is exerted on a first force transmission means 2, at which, when a maximum adjustable force exertion $K_{max}$ is reached, a clearly audible signal is generated. The clearly audible signal is primarily generated by the interaction of oscillatory elements 5, 8, 9 of the device 1.

The features of the above-described embodiments may obviously be combined with one another as desired, so a feature from the one embodiment can also be taken up in another embodiment without departing from the basic idea of the invention.

LIST OF REFERENCE SIGNS

1 device
2 first force transmission means
3 base plate
4 spring element
5 clicking plate
7 curvature
8 spring element
9 oscillatory web
9' recess

10 support point
13 projection
13' elevation
14 snap fit
15 lower side of the base plate
16 shaped part made of suitable foam
17 thin end of the base plate 3
17' thinner end of the foam part 16
18 thick end of the base plate 3
19 elevation
20 curvature
21 bending edge
22 annular face
23 curved elevation
4, 5, 8, 16 spring system
4, 5, 8, 9 spring system
5, 8, 9 unit generating a signal
8, 9 oscillatory element
d thickness
D thickness
S signal
K force
$K_{max}$ limit pressure/maximum force effect

The invention claimed is:

1. A multi-part device for generating a clearly audible sound when an outer force (K) acts on a first force transmission means, the multi-part device comprising the first force transmission means, a base plate, and a spring system comprising one or more first spring elements on the base plate, wherein the force transmission means comprises a peripheral edge and acts via the spring system on the base plate in an apparatus for controlled cardiopulmonary resuscitation of a human body during cardiac arrest, wherein the spring system further comprises a lateral spring element positioned between the first force transmission means and the base plate, said lateral spring element configured as a clicking plate with at least one curvature which spontaneously generates a clicking sound when a predetermined bending is reached in one direction, wherein sound vibrations generated by the clicking plate act on the first force transmission means as a resonance body, wherein the spring system further comprises a second spring element able to transmit the force (K) to the clicking plate, said apparatus having outer geometric dimensions and shapes adapted to anatomical conditions of a human thorax close to the sternum, wherein the multi-part device comprises at least one elevation on a plane of the base plate, which interacts with at least one projection arranged on an inner surface of the first force transmission means by snap fit, wherein all of said one or more first spring elements, said second spring element, and said clicking plate are under a predetermined prestress, wherein the at least one elevation on the plane of the base plate extends vertically toward the first force transmission means, and the at least one projection extends vertically toward the plane of the base plate, wherein at least one of the one or more first spring elements is arranged to a side of the clicking plate in the lateral direction and wherein the at least one elevation and at least one projection are located at a lateral position between the clicking plate and the peripheral edge of the first force transmission means, wherein the at least one elevation and the at least one projection are spaced apart from the peripheral edge of the force transmission means.

2. The multi-part device according to claim 1, wherein the clicking plate is configured to be oval, polygonal, heart-shaped, or round.

3. The multi-part device according to claim 1 further comprising peripherally arranged oscillatory elements on the first force transmission means.

4. The multi-part device according to claim 1, wherein the clicking plate independently springs back resiliently.

5. The multi-part device according to claim 1, wherein the clicking plate is arranged coaxially with respect to the first force transmission means.

6. The multi-part device according to claim 1, wherein the clicking plate is planar and rests loosely at least on three narrow support points at an edge of the clicking plate.

7. The multi-part device according to claim 1, wherein the clicking plate is in the shape of an annular disc.

8. The multi-part device according to claim 1, wherein at least one oscillatory element is a lateral oscillatory web having an angular or arcuate recess.

9. The multi-part device according to claim 1 further comprising a shaped foam, the surface of which is concave, arranged on the outside of the base plate.

10. The multi-part device according to claim 1, wherein the first force transmission means comprises a concave cover face.

11. The multi-part device according to claim 1, wherein the at least one spring element is configured as a coiled spring.

12. The multi-part device according to claim 1, wherein said at least one elevation is positioned closer to the center of the multi-part device in the lateral direction than said at least one of the one or more first spring elements.

13. The multi-part device according to claim 1, wherein said at least one elevation is positioned closer to the center of the multi-part device in the lateral direction than at least one of the one or more first spring elements.

14. A method using the multi-part device according to claim 1 for generating a clearly audible sound when an outer force (K) acts on the first force transmission means, which acts via the spring system on the base plate for controlled cardiopulmonary resuscitation of a human body during cardiac arrest, said method comprising generating a clearly audible signal by means of interaction of the spring system and transmitting the signal to oscillatory elements when an adjustable limit pressure ($K_{max}$) is reached.

* * * * *